United States Patent [19]

Sugiura

[11] 4,360,279

[45] Nov. 23, 1982

[54] PRINTING PAPER FEEDING MECHANISM

[75] Inventor: Toshiro Sugiura, Nagoya, Japan

[73] Assignee: Brother Kogyo Kabushiki Kaisha, Nagoya, Japan

[21] Appl. No.: 275,770

[22] Filed: Jun. 22, 1981

[30] Foreign Application Priority Data

Jul. 2, 1980 [JP] Japan ..... 55-91069
Jul. 10, 1980 [JP] Japan ..... 55-94144
Jul. 10, 1980 [JP] Japan ..... 55-94145

[51] Int. Cl.[3] ..... B41J 11/48

[52] U.S. Cl. ..... 400/600.2; 400/618; 400/631; 400/632; 271/228

[58] Field of Search ..... 400/605, 595, 600, 600.2, 400/600.3, 618, 631, 632, 611, 613, 613.1, 616.2, 624, 625; 271/8 R, 109, 526, 278

[56] References Cited

U.S. PATENT DOCUMENTS 2,963,138 12/1960 Motte et al. ..... 400/600.3
3,746,142 7/1973 Hepp et al. ..... 400/618
4,072,225 2/1978 Manning et al. ..... 400/618
4,173,420 11/1979 Okabe ..... 400/618
4,251,162 2/1981 Kammerer et al. ..... 400/631 X

OTHER PUBLICATIONS

Bateson et al, "Dual-Motor Forms Feed Drive", IBM Tech. Discl. Bulletin, vol. 22, No. 7, Dec. 1979, pp. 2616–2617.

*Primary Examiner*—E. H. Eickholt
*Attorney, Agent, or Firm*—Browdy and Neimark

[57] ABSTRACT

A printing paper feeding mechanism for a printer having a pin tractor for feeding a web with holes perforated at periodic locations along both edges and a pair of rollers for drawing out the web fed by the pin tractor through a printing position while pinching the web under pressure. The pin tractor and one of the rollers are driven by a motor through a transmitting device such that the rollers are imparted a slightly faster feeding action than the pin tractor for preventing the web from being slackened. The rollers are adapted to be used independently of the pin tractor for feeding a cut sheet paper at the same speed as the web fed by the pin tractor by driving the motor at a reduced amount of rotation for a unit line spacing amount than usual.

11 Claims, 15 Drawing Figures

FIG. 8
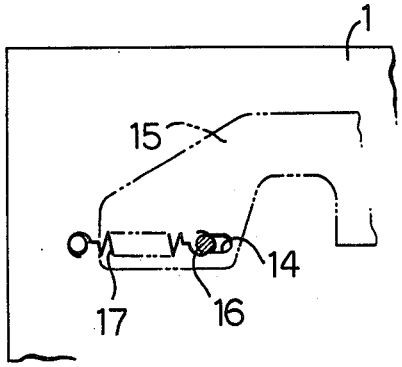
FIG. 10
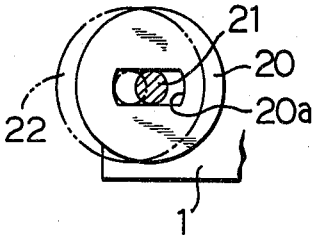
FIG. 12
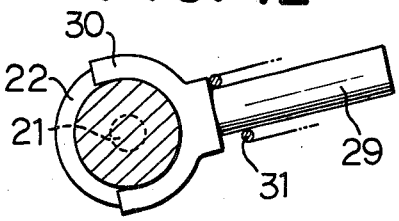
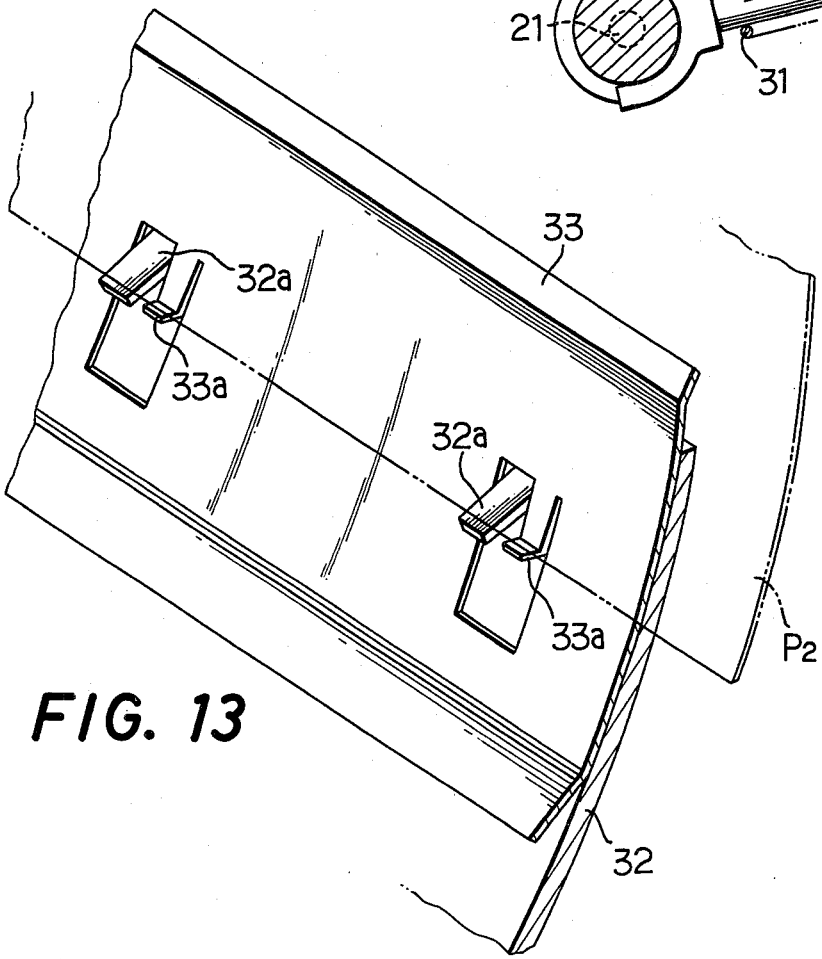
FIG. 13

PRINTING PAPER FEEDING MECHANISM

BACKGROUND OF THE INVENTION

This invention relates to a paper feeding mechanism for a printer for feeding both perforated paper, namely web with holes perforated at periodic locations along both edges, and cut sheet paper without the perforation.

In paper feeding mechanisms for feeding perforated paper a paper feeding device having a pin tractor for improving the feed precision to a printing position generally feeds paper to the printing position, while the perforated paper is drawn out by a paper draw-out device from the printing position. And in this paper feeding mechanism paper draw-out speed in the paper draw-out device is so designed as to be slightly faster than paper feed speed in the paper feeding device. The perforated paper running in the mechanism is well prevented from being slackened so as to be kept in high feed precision.

In the feeding of cut sheet paper the above-mentioned paper feeding device with a pin tractor is impracticable, and the paper draw-out device is also unsuitable because of its faster feed speed than the normal feed speed due to the paper feeding device. Due to such a situation a different paper feeding mechanism from the above-mentioned one has been employed for the cut sheet paper feeding operation.

It has obliged double purposed printers handling not only perforated paper but also cut sheet paper to possess a complicated paper feeding mechanism, and the complexity of the mechanism has made the operation thereof inevitably troublesome.

SUMMARY OF THE INVENTION

It is therefore a primary object of this invention to provide a paper feeding mechanism of simple structure serviceable not only to perforated paper but also to cut sheet paper.

It is another object of this invention to provide a paper feeding mechanism wherein a part of a paper feeding device for perforated paper can be concurrently used for feeding of cut sheet paper.

It is still another object of this invention to provide a paper feeding mechanism wherein a part of the paper feeding device for perforated paper is serviceable to the feeding of cut sheet paper and damage or impair to the perforated paper is well prevented.

It is further object of this invention to provide a paper feeding mechanism capable of surely and exactly setting cut sheet paper at a predetermined position.

For achieving these objects, the paper draw-out device is adapted to be used independently of the pin tractor for feeding the cut sheet paper at the same speed as the perforated paper fed by the pin tractor by driving the motor for actuating the paper draw-out device at a reduced amount of rotation for a unit line spacing amount than usual.

According to this invention there is provided a printing paper feeding mechanism for a printer comprising (1) a perforated paper feed device provided with a pin tractor, for feeding a web with holes perforated at periodic locations along both edges toward a printing position, fittable into said perforations, (2) a paper draw-out device comprising a rotatable drive roller and a pressure roller, abuttable thereto for being able to rotate associated therewith, for drawing out a paper printed at the printing position therefrom while holding said paper under pressure between both rollers, (3) a transmitting device for connecting said perforated paper feeding device and said paper draw-out device to impart larger amount paper drawing out action to said paper draw-out device than paper feeding amount by said perforated paper feed device, (4) a motor for driving said perforated paper feed device and said paper draw-out device, and (5) a rotation amount controlling means for changing amount of rotation of said motor for a unit line spacing amount in response to the type of paper fed, such that fed amount of paper in either case wherein the perforated paper is fed by said perforated paper feed device and said paper draw-out device and wherein a cut sheet paper is fed by said paper draw-out device alone may be made equal.

This printer is preferably provided with a pressure controlling means for changing contact pressure of said pressure roller to said drive roller to a weaker level, while paper feeding by said perforated paper feed device is conducted, than that in otherwise operation.

According to this invention there is also provided a printing paper feeding mechanism for a printer comprising (1) a paper feed device, disposed above a printing position, comprising a rotatable drive roller and a pressure roller abuttable to said drive roller and rotatable in association therewith for feeding a cut sheet paper while holding said paper between the both rollers under pressure, (2) an operable member which is operated for separating said pressure roller from said drive roller to load said paper from above said printing position passing through between the both rollers, (3) a positioning member, normally located at an original position so as not to obstruct the paper feeding operation, and shiftable to an operative position beneath the printing position for being abutted by, and for supporting, the lower end of said paper when it is loaded, (4) linkage means for linking said positioning member and said operable member to move said positioning member to said operative position prior to the separating operation of said pressure roller owing to operation of said operable member and to return said positioning member from said operative position to said original position after said pressure roller has been abutted onto said drive roller, and (5) an initial drive means for rotating said drive roller for the purpose of transporting said paper loaded by the operation of said operable member to a print starting position.

BRIEF DESCRIPTION OF THE DRAWING

FIG. 1 through FIG. 4 are vertical sectional side views of an embodiment of a paper feeding mechanism wherein an operating lever is respectively located at first to fourth position;

FIG. 8 is a vertical sectional side view for showing supporting structure for a support plate;

FIG. 10 is an enlarged cross sectional view of a bearing;

FIG. 12 is an enlarged cross sectional view of a supported portion of a pressure roller;

FIG. 13 is partial perspective view for showing a paper guide;

DETAILED DESCRIPTION OF THE PREFERRED EMBODIMENT

With reference to the appended drawing a preferred embodiment of this invention which is realized in a dot-printer will be described hereunder.

Figure 1:
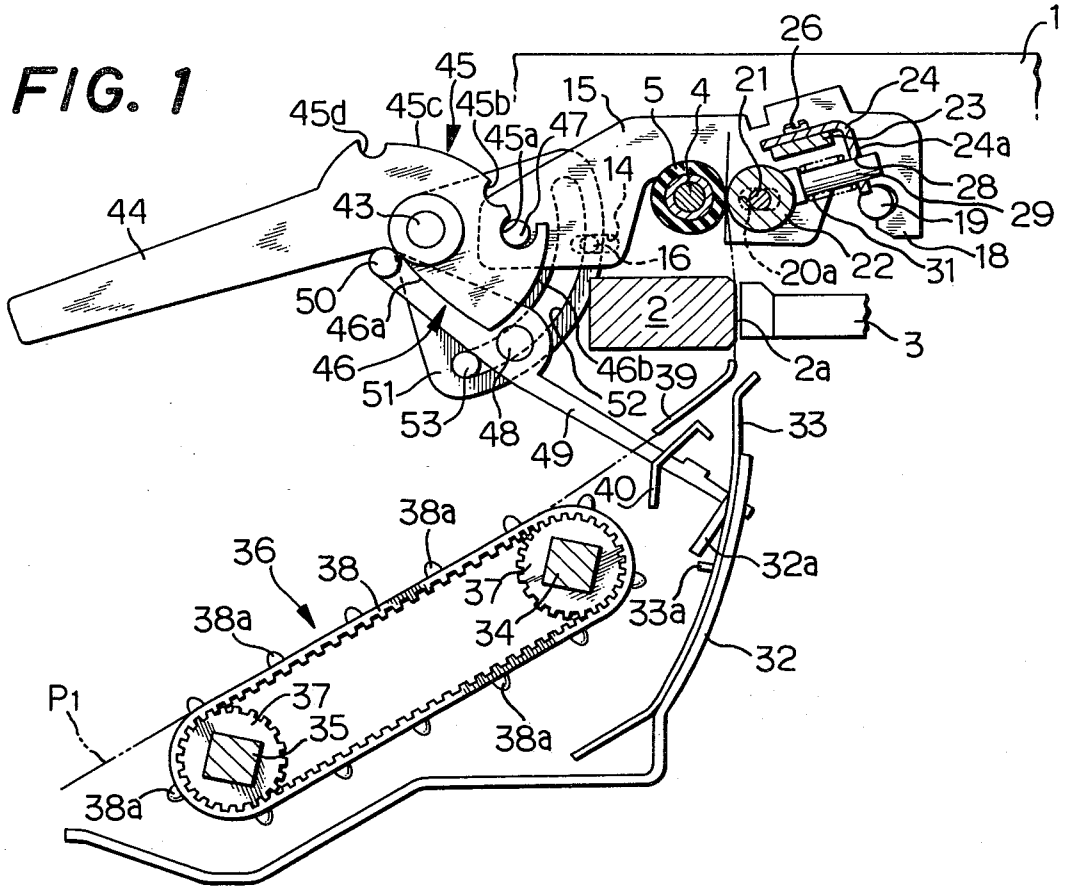
FIG. 1 and following all drawings are for showing an embodiment in which this invention is realized.

As can be seen in FIG. 1, a platen 2 is secured on an upper portion of a pair of side frames 1 and a print head 3 is shiftably disposed along a printing surface 2*a* of the platen 2. Printing is executed by the print head 3 with a dot matrix on a perforated paper $P_1$ or a cut sheet paper $P_2$ passing over the printing surface 2*a*.

Figure 5:
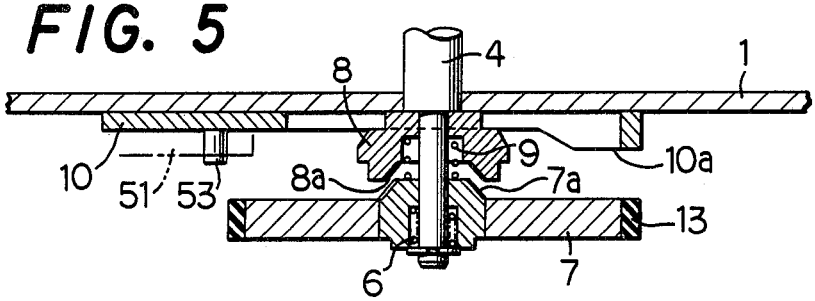
FIGS. 5 and 6 are respectively a sectional plan view of a one way clutch, being in operating state and in nonoperating state.
Figure 6:
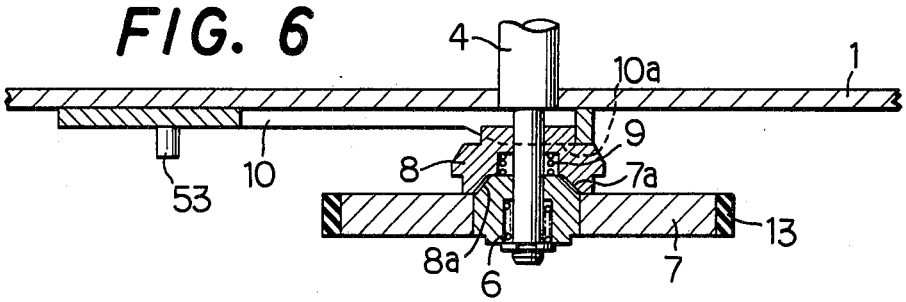

Above the platen 2 a drive shaft 4 is extending between the pair of side frames 1 for being rotatably supported by them, on the outer periphery thereof a drive roller 5 of an elastic material is fixed. On one end of the drive shaft 4 a pulley 7 is carried, as shown in FIGS. 5 and 6, by way of a one-way clutch 6 constituted of a coil spring. On one side of a boss of the pulley 7 an engaging portion 7*a* having a plurality of engaging teeth on the periphery thereof is formed. Adjacent to the pulley 7 a clutch member 8 is carried by the drive shaft 4 shiftably only in an axial direction. On the inside surface of the clutch member 8 an engaging portion 8*a* having a plurality of engaging teeth engageable with the engaging portion 7*a* of the pulley 7 is formed. Between the clutch member 8 and the boss of the pulley 7 a spring 9 is interposed for biasing the both (7, 8) in a separating direction from each other.

Between the clutch member 8 and the side frame 1 a clutch rod 10 is forward-and backwardly shiftably disposed, one end of which is provided with a cam portion 10*a*. While the clutch rod 10 is rearwardly positioned as shown in FIG. 5 the clutch member 8 is separated from the boss of the pulley 7 due to the biasing force of the spring 9; and when the clutch rod 10 forwardly shifted as shown in FIG. 6 the cam portion 10*a* is engaged with the clutch member 8 for letting the clutch member 8 engage with the boss of the pulley 7 due to the action of the cam portion 10*a*. Incidentally, left side in FIGS. 1 to 6 designates the front or forward side of the mechanism in this specification.

Figure 7:
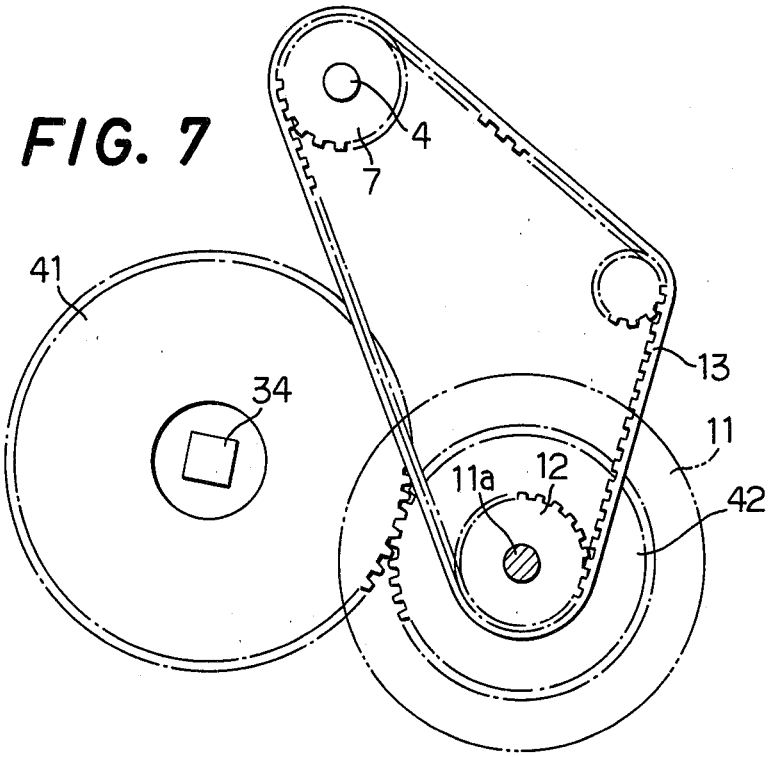
FIG. 7 is a vertical sectional side view of a drive transmission mechanism including a drive motor.

As shown in FIG. 7, a bidirectionally rotatable motor 11 is disposed. Between a pulley 12 secured to a motor shaft 11*a* of the motor 11 and the pulley 7 a belt 13 is stretched. While the clutch rod 10 is placed at a position designated in FIG. 5 for separating the engaging portion 8*a* of the clutch member 8 from the engaging portion 7*a* of the pulley 7, only one directional rotation of the pulley 7 is delivered to the drive shaft 4 due to the action of the one-way clutch 6 so as to rotate the drive roller 5 in an anticlockwise direction in FIG. 1 only. While on the contrary the clutch rod 10 is placed at a position shown in FIG. 6 for keeping the both engaging portions 7*a*, 8*a* in mutual engagement the pulley 7 and the drive shaft 4 are capable of integrally rotating in either the positive (forward) or the negative (backward) direction. This consequently allows the drive roller 5 to be rotated anticlockwise and clockwise direction in FIG. 1 in response to the positive and negative rotation of the motor 11.

In either of the side frames 1 above the platen 2 an elongated slot 14 is formed as shown in FIGS. 1 and 8. A support plate 15 provided with a support pin 16 engageable with the elongated slot 14 is movably carried between a position shown in FIG. 1 and a position in FIG. 4 inside the side frame 1, and furthermore it is allowed to be turned upwards about the support pin 16 from the posture in FIG. 1 to that in FIG. 9. The support plate 15 is forwardly, leftwardly in FIG. 8, biased by a spring 17 anchored between the same and a fixed portion of the side frame 1. On the lower portion of the support plate 15 a hook portion 18 is formed for being engaged with a pin 19 secured to the side frame 1, while the support plate 15 is positioned as shown in FIG. 1, so as to keep the support plate 15 at that position.

In the pair of the support plates 15 a bearing 20 is respectively fixed as shown in FIG. 10, and a bore 20*a* of which extends horizontally to be an elongated hole. Between the two bores 20*a* a support shaft 21 is retained rotatably and forward-and backwardly shiftably, on which a pressure roller 22 contactable to and separatable from the periphery of the drive roller 5. When the pressure roller 22 is contacted with the drive roller 5 under pressure, the former is rotated with the latter in association relation, which draws out in turn the perforated paper $P_1$ and the cut sheet paper $P_2$ printed on the printing surface 2*a* of the platen 2. It signifies that both rollers 5, 22 constitute the perforated paper drawing out device for drawing out a printing paper.

Figure 11:
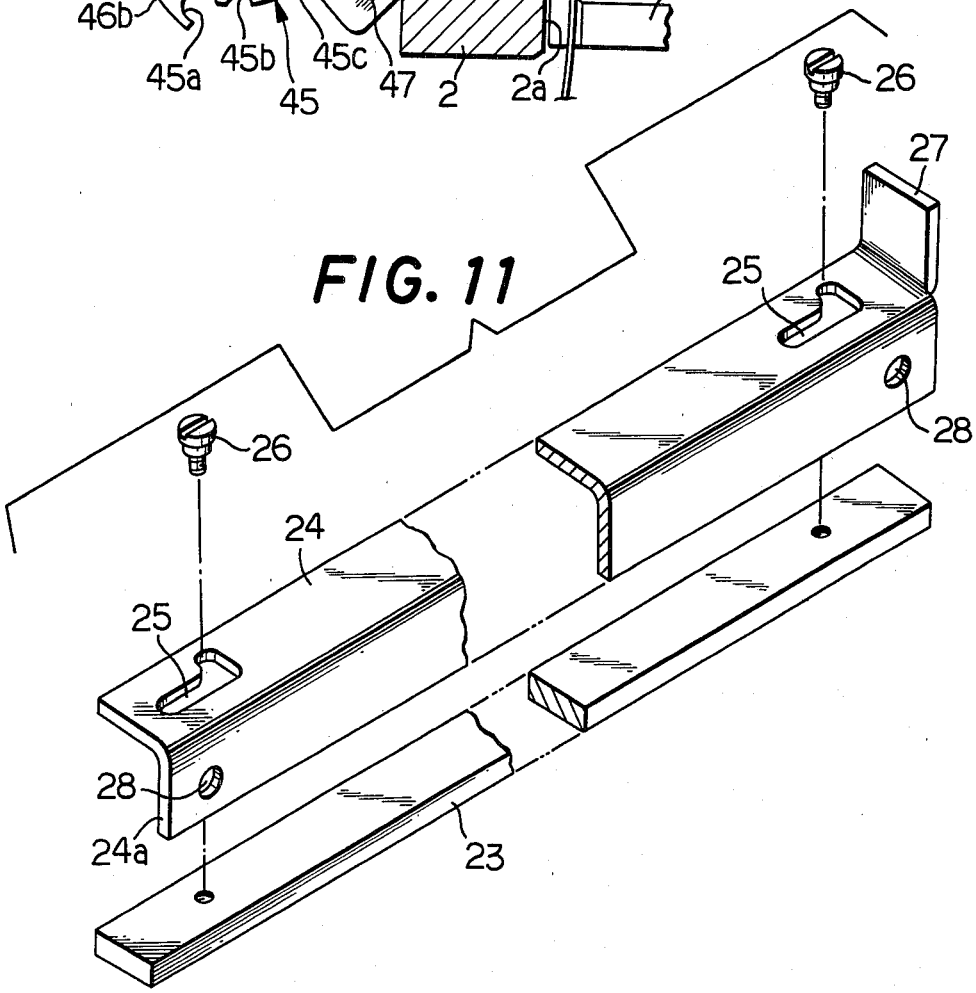
FIG. 11 is an exploded perspective view of a plate for receiving a spring and related structure.

As shown in FIGS. 1 and 11 a support bar 23 is spanned between the pair of support plates 15, on which a plate 24 of L-shape in section is placed. In either end portion of the plate 24 a guide slot 25 of L-shape is formed, and a guide pin 26 is planted on either end portion of the support bar 23 respectively for being pierced through the guide slot 25. So the plate 24 is so carried as to be shiftable along the pair of guide slots 25. An operating portion 27 is formed on one end of the plate 24 by bending a part thereof for the purpose of moving or shifting the same.

In a plurality of guide apertures 28 formed in walls 24*a* of the plate 24 a stud 29 is respectively slidably inserted for holding, as shown in FIG. 12, at a support portion 30 formed on the end thereof a part of the support shaft 21. On the stud 29 a spring 31 is wound for biasing the pressure roller 22 toward the drive roller 5 via the support portion 30. Switching between two positions, forward and backward, of the plate 24 in relation to the support bar 23 will change the biasing force of the spring 31, which in turn switches over the contacting pressure of the pressure roller to the drive roller 5. In this way a contact pressure switching device is constituted by the plate 24, the stud 29 and, the spring 31.

Below the print head 3 a base plate 32 is secured as shown in FIG. 1, extending between and, to the pair of the side frames 1. On the base plate 32 a plurality of guide portions 32*a* are formed as shown in FIG. 13 by cutting and bending a part of the plate in downward slant direction. On the base plate 32 a paper guide 33 is movably laid up-and downwardly ranging between a lower position shown in FIGS. 1 and 2 and an upper position shown in FIGS. 3 and 4 wherein the upper end thereof is positioned right beneath the pressure roller 22. On the paper guide 33 a plurality of abutments 33*a* are formed by cut and bend, with a predetermined inter-distance and positioned substantially in the middle portion between top and bottom thereof, for receiving the lower end of the cut sheet paper $P_2$ which is inserted from upper side through both rollers 5, 22 when the paper guide 33 is shifted upwards to the above-mentioned upper position. When the paper guide 33 is shifted down to the lower position the abutments 33*a* are positioned below the guide portions 32*a* so as not to obstruct the downward feeding of the cut sheet paper $P_2$.

Between the platen 2 and the base plate 32, two rotating shafts 34, 35 are disposed, retained by and ranging between, the pair of side frames 1, and a pair of pin tractors 36 are attached between the two rotating shafts 34, 35 slant-upwardly in a manner of linking the two. The pin tractor 36 is respectively composed of a pair of pulleys 37 secured each to the rotating shafts 34, 35 and a belt stretched around the both pulleys 37. On the external surface of the belts 38 a multiplicity of pins 38*a* are fixed at a predetermined inter-distance. The perforated paper $P_1$ is at feeding perforations on either edges thereof engaged with the pins 38*a* located on the upper running side of the pair of the belts 38 for being fed to the printing position between the platen 2 and the print head 3 according to the rotation of the belts 38. The pin tractor 36 of the earlier mentioned structure constitutes the perforated paper feeding device.

Between the pin tractors 36 and the printing surface 2*a* of the platen 2 guide plates 39, 40 are disposed for guiding the perforated paper $P_1$.

As shown in FIG. 7, on one end of the rotating shaft 34 a gear 41 is secured for being engaged with a gear 42 secured on the motor shaft 11*a* of the motor 11. So the belt 38 may be forwardly or backwardly rotated in response to the forward or backward rotation of the motor 11. And the gear ratio is so determined as to make the paper feed speed, i.e., the revolving speed of the belt 38 due to the motor rotation, lower by 10% than the paper draw-out speed owing to the both rollers 5, 22. A transmitting device for imparting to a paper draw-out device paper drawing out function of larger amount than the paper feed amount by the perforated paper feeding devide is thus composed of the gears 41, 42, the pulleys 7, 12, and the belt 13, etc.

On the side frame 1 an operating lever 44 is carried, as shown in FIG. 1, by a stud 43 on the front side of the support plate 15, and on the periphery of one end thereof cam surfaces 45, 46 are formed. The cam surface 45 is composed of continuously formed a first notch 45*a*, a second notch 45*b*, a cam surface of gentle arc form 45*c*, and a third notch 45*d*, and the cam surface 46 is composed of continuously formed of a first cam portion 46*a* extending outwardly and a second cam portion 46*b* located on an arc having its center at the stud 43.

A follower pin 47 fixed to the support plate 15 due to the biasing force of the spring 17, shown in FIG. 8, is being contacted under pressure to the cam surface 45. While the operating lever 44 is in a first position shown in FIG. 1 the follower pin 47 is engaged with the first notch 45*a*, and the support plate 15 is consequently located in a forward position shown in FIG. 1, for keeping the pressure roller 22 in pressure-contacted state to the drive roller 5. When the operating lever 44 is rotated from the position in FIG. 1 to a second position in FIG. 2, the follower pin 47 is engaged with the second notch 45*b* for moving the support plate 15 further forward from the position in FIG. 1 to the forwardmost position in FIG. 2, with a result of heavy pressing of the drive roller 5 by the pressure roller 22. When the operating lever 44 is further rotated up to a third position shown in FIG. 3 the follower pin 47 is engaged with the middle portion of the cam surface 45*c* so as to shift the support plate 15 to a position in FIG. 3 further back sided position than in FIG. 2, while maintaining the pressure roller 22 in contact with the drive roller 5. When the operating lever 44 is rotated to a fourth position shown in FIG. 4 the follower pin 47 is engaged with the third notch 45*d* for pushing the support plate 15 to the backward most position shown in FIG. 4 which is much more back sided than in FIG. 3. The pressure roller 22 is at this time separated from the drive roller 5 so as to form a clearance between the two rollers 5, 22.

In the neighborhood of the operating lever 44 a connecting lever 49 is rotatably retained by a stud 48 fixed to the side frame 1. A follower pin 50 disposed on one end thereof is engaged with the cam surface 46 of the operating lever 44 due to the biasing force of a not-shown spring, and the other end thereof is engaged with a part of the paper guide 33. Due to the rotation of the connecting lever 49 the paper guide 33 is moved up-and downwards.

Figure 2:
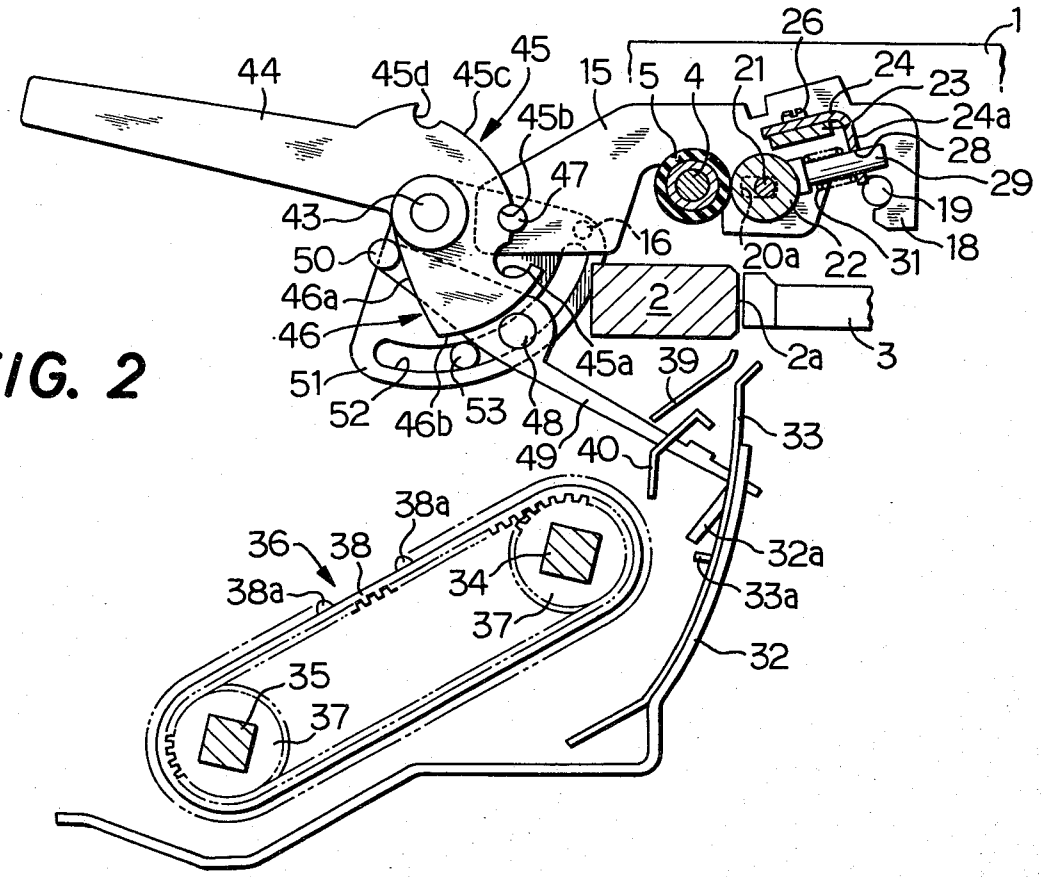
Figure 3:
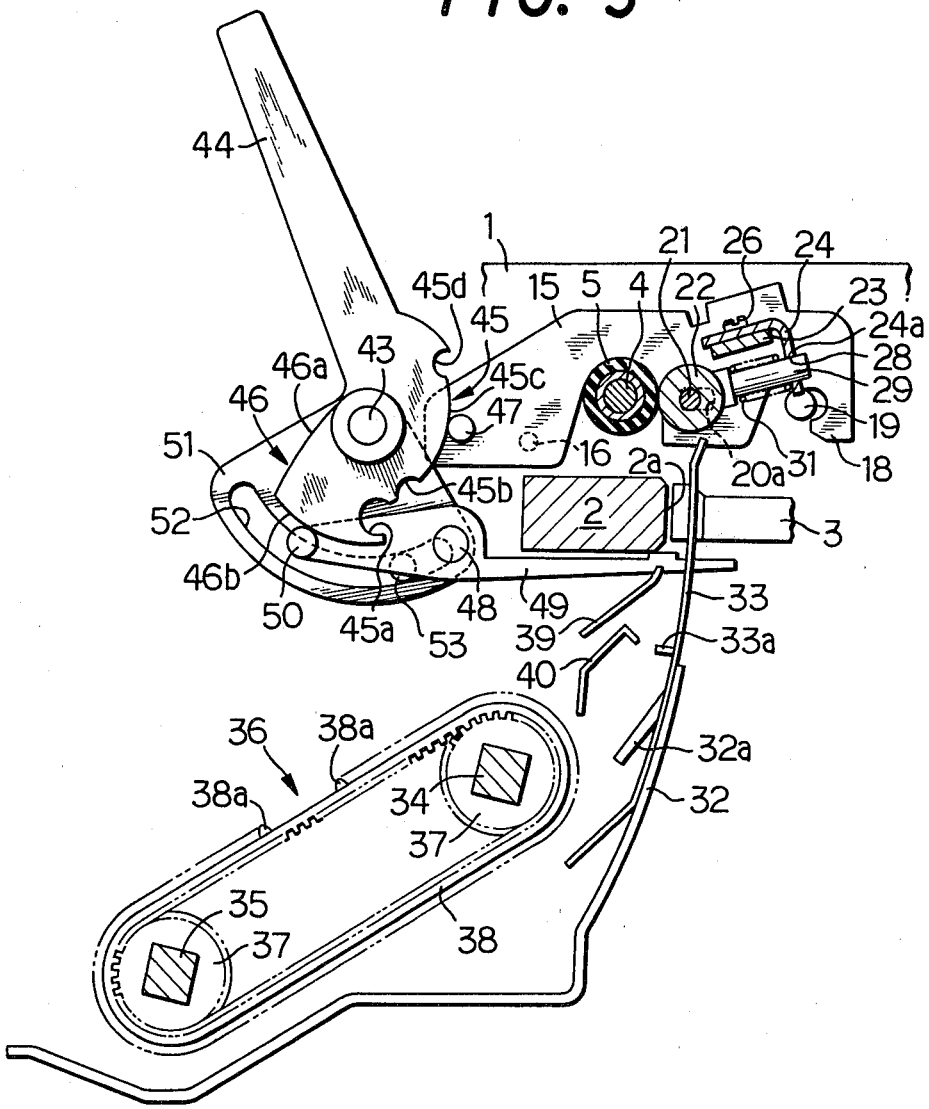

While the operating lever 44 is in the first and second position illustrated in FIGS. 1 and 2, the follower pin 50 is engaged with the first cam portion 46*a* to keep the paper guide 33 at the lower position. When the operating lever 44 is rotated to the third and fourth position illustrated in FIGS. 3 and 4, however, the follower pin 50 is engaged with the second cam portion 46*b* to move the paper guide 33 to the upper position, positioning the abutments 33*a* right beneath the printing position.

On the stud 43 for the operating lever 44 a plate 51 of a fan shape is secured, along the periphery thereof an arcuate slot 52 having a constant radius from the stud 43 is formed. In this arcuate slot 52 a stud 53 fixed on the clutch rod 10 is fitted, as can be seen in FIG. 1 and in FIG. 5. When the operating lever 44 is rotated from the third position in FIG. 3 to the fourth position in FIG. 4, engagement of the stud 53 with one end of the arcuate slot 52 moves the clutch rod 10 for rendering the clutch member 8 to take the posture shown in FIG. 6 being engaged with the pulley 7. When the operating lever 44 is rotated from the second position in FIG. 2 to the first position in FIG. 1 the stud 53 is engaged with the other end of the arcuate slot 52 to move the clutch rod 10 back to the original position for rendering the clutch member 8 separated from the pulley 7 as shown in FIG. 5.

Figure 14:
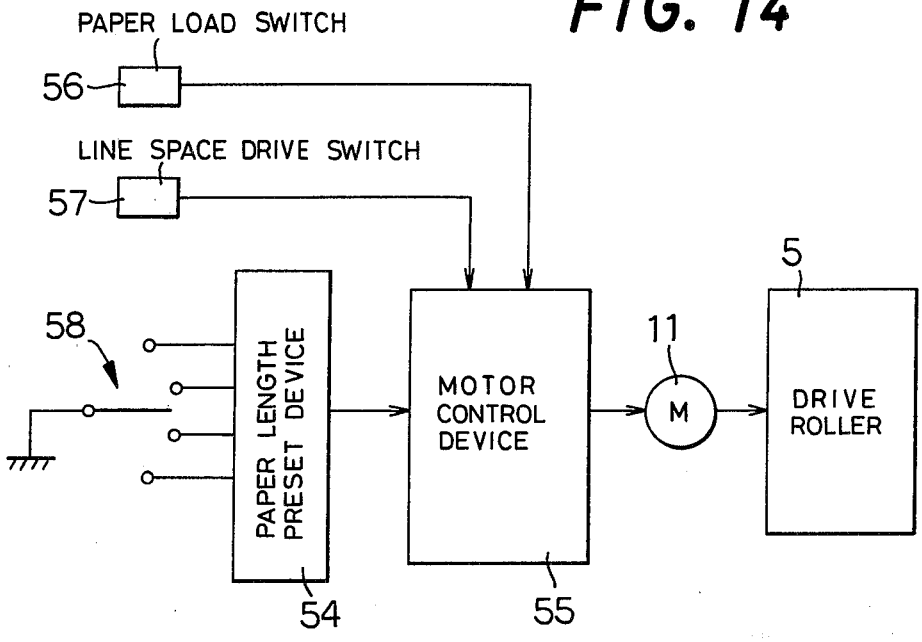
FIG. 14 is a block diagram for showing a initial driving circuit.

With reference to FIG. 14, structure of an initial or starting drive circuit for the drive roller 5 with the purpose of transferring the cut sheet paper $P_2$ loaded in place accompanying the operation of the operating lever 44 to a print starting position will be described. This initial drive circuit is composed of a paper length preset device 54, a motor control device 55, a paper load switch 56, and a line space drive switch 57. The paper length preset device 54 is capable of, according to switching operation of a mode change switch 58, generating a predetermined output signal corresponding to the length in vertical direction of the cut sheet paper $P_2$. The motor control device 55 generates a rotation control signal, when the paper load switch 56 is operated, in response to the output signal of the paper length preset device 54, which causes in turn the motor 11 to rotate the drive roller 5 in clockwise direction (in FIG. 11) by a predetermined amount followed by moving of the cut sheet paper $P_2$ to the starting position for printing. The line space drive switch 57 is operated at each finishing of one line printing for actuating the motor control device 55. The drive roller 5 is rotated by the thus actuated motor 11 in a line spacing direction, i.e., anti-clockwise direction.

Figure 15:
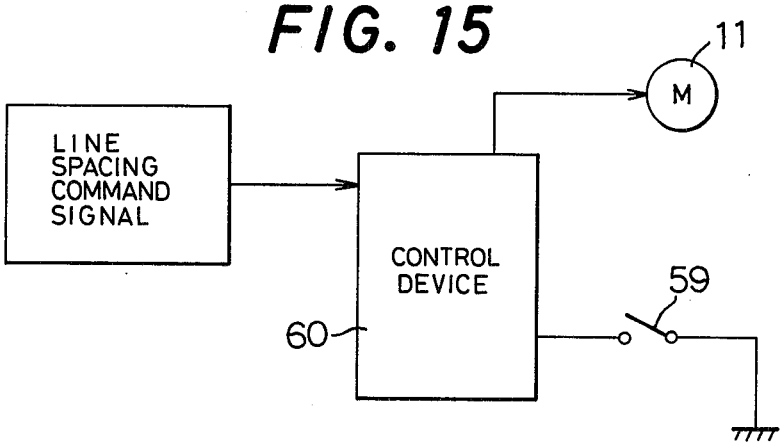
FIG. 15 is a block diagram for showing a controlling circuit of rotation amount.

In this printing device a controlling circuit of the rotation amount for the motor 11 upon a line spacing command signal is disposed as shown in FIG. 15, which is composed of a switch 59 to be closed when the cut sheet paper $P_2$ is required to be fed and a control device 60 for controlling the rotation amount of the motor 11. As a matter of fact the control device 60 are made up into a circuit together with the motor control device 55. When the line spacing command signal is entered the control device 60 while the switch 59 is in closed state the motor 11 is supposed to rotate at a rotation amount 10% less than while the switch 59 is not closed.

Operation of the paper feeding mechanism of such a structure will be described hereunder. For printing on a perforated paper $P_1$ the urging force of the pressure roller 22 onto the drive roller 5 must be diminished in a state shown in FIG. 1, by means of setting the plate 24 at the backward position for reducing the biasing force of the spring 31. The print head 3 is on the other hand located at a spaced stand-by position so as not to obstruct the upward moving of the paper guide 33.

Figure 4:
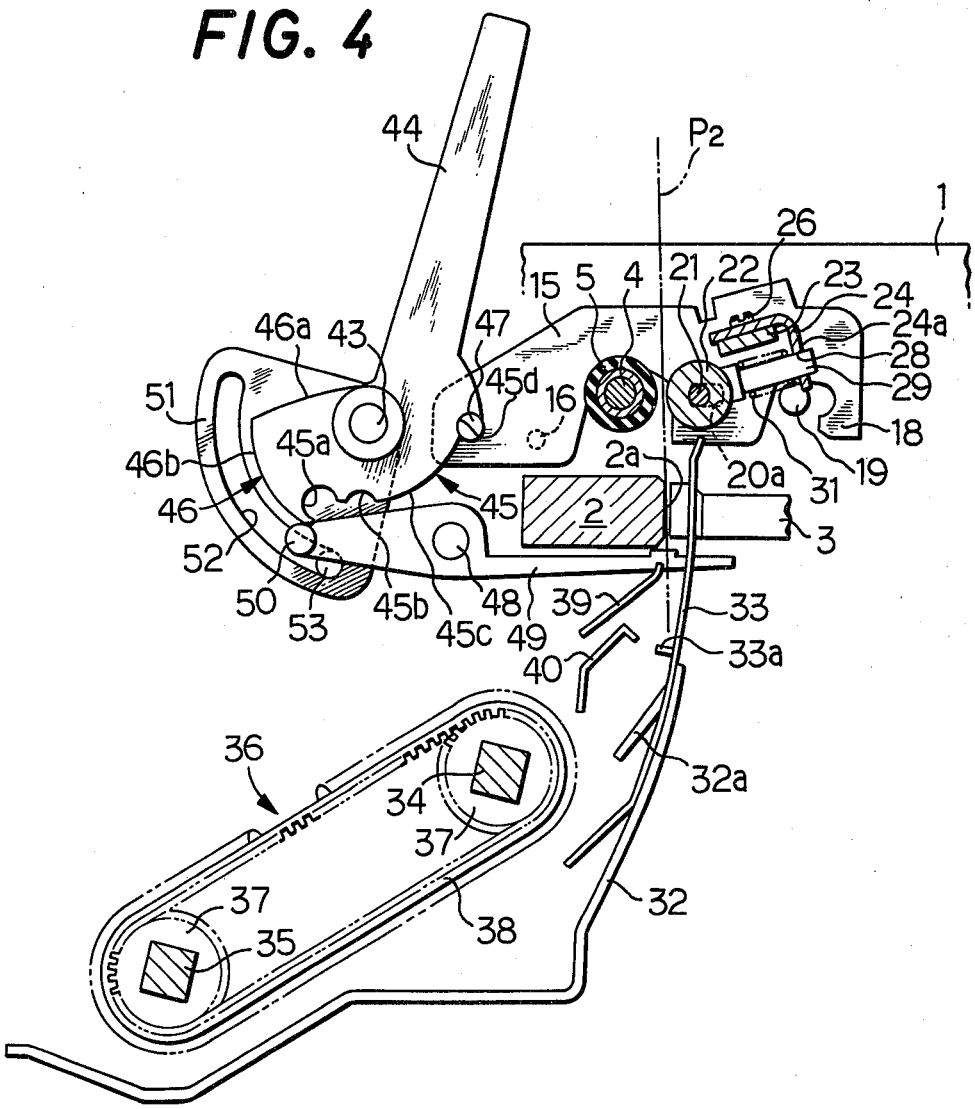

When the operating lever 44 is rotated next to the position illustrated in FIG. 4 the support plate 15 is moved backwards as stated earlier and the pressure roller 22 is separated from the drive roller 5, while the paper guide 33 is moved upwards due to the rotation of the connecting lever 49. The clutch rod 10 is moved by the plate 51 to the forward position shown in FIG. 6 for rendering the clutch member 8 engaged with the pulley 7.

Figure 9:
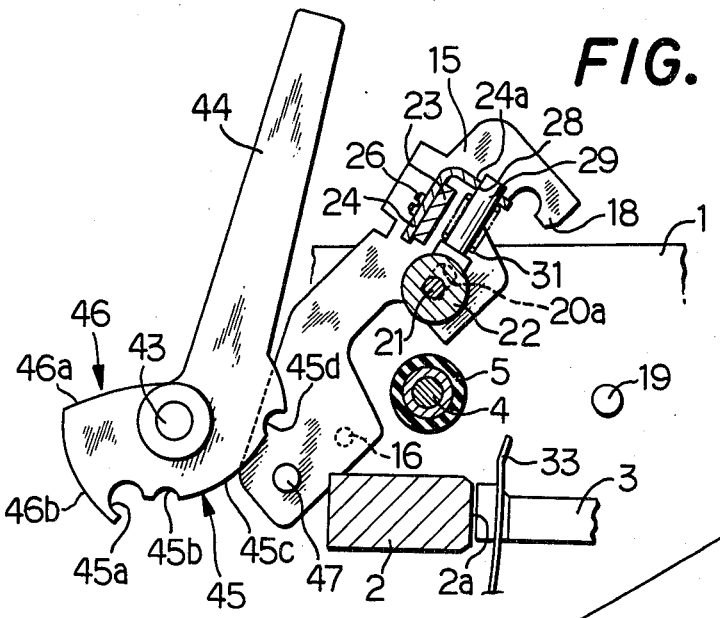
FIG. 9 is a vertical sectional side view of the support plate which is being rotated upwards.

At this state the support plate 15 is rotated upwards about the support pin 16 as shown in FIG. 9 and the pressure roller 22 is moved upwards, and then the pin tractor 36 with a perforated paper $P_1$ put at a predetermined position is revolved clockwise in FIG. 4. By the above-mentioned operation the perforated paper $P_1$ is passed through between the guide plates 39, 40, at the leading end thereof, as far as the rear side of the drive roller 5 by being guided by the above located paper guide 33. That is to say, the perforated paper $P_1$ is set at the print initiating position. During this operation the print head 3 is located at a spaced stand-by position and the pressure roller 22 is upwardly moved to make the above space of the printing position open or clear, setting of the perforated paper $P_1$ to the print starting position is made smooth and hitchless.

When thereafter the support plate 15 is returned to the lower position shown in FIG. 4 and operating lever 44 is rotated to the first position shown in FIG. 1, the support plate 15 is naturally returned to the forward position so as to render the leading end of the perforated paper $P_1$ being held between both rollers 5, 22. At the same time, due to the rotation of the connecting lever 49 the paper guide 33 is returned to the lower position, and the clutch rod 10 is also returned to the backward position by the plate 51. The above-mentioned operation separates the clutch member 8 from the pulley 7 as the state shown in FIG. 5 while making the one way clutch 6 is placed in an operable status. When printing is executed under such a condition, every entering of the line spacing command signal to the control device 60 shown in FIG. 15 makes the motor 11 rotate by a predetermined amount, and the pin tractor 36 is consequently revolved via the gears 42, 41 shown in FIG. 7. The drive roller 5 is also rotated via the pulley 12, the belt 13, and the pulley 7, inducing the rotation of the pressure roller 22, followed naturally by upward moving of the perforated paper $P_1$ and line spacing.

As the paper draw-out speed of the two rollers 5, 22 in this instance is somewhat faster than the paper feeding speed due to the pin tractor 36 the perforated paper $P_1$ is constantly placed under tension, allowing clear printing at an exact position be made thereon. Since the spring force applied to the pressure roller 22 is in this case set at a weaker lever, smooth and easy sliding is expected between the perforated paper $P_1$ and the both rollers 5, 22. Irrespective of the faster speed drawing out the perforated paper $P_1$ is well prevented from breakage thereof at perforated places and a long continued paper with perforation lines in the traverse direction can never be broken at the perforation line.

When the rotational direction of the motor 11 is reversed accompanied by reversed revolving of the pin tractor 36, the rotation of the pulley 7 is suspended from being delivered to the drive shaft 4 due to the action of the one way clutch 6, allowing the perforated paper $P_1$ to be fed in a reversed direction under tension through between the both non-rotating rollers 5, 22. In other words, if the both rollers 5, 22 are driven in the reverse directional feeding of the perforated paper $P_1$, it may be slackened or wrinkled because of the faster feeding speed thereon by the both rollers 5, 22 than the feeding speed of the pin tractor 36.

When printing on a cut sheet paper $P_2$ is desired the operating lever 44 is rotated from the position in FIG. 1 to the fourth position in FIG. 4 and the plate 24 is moved to the forward position. This will form a clearance between the both rollers 5, 22 and make the clutch member 8 engage with the pulley 7. And the pulley 7 and the drive shaft 4 are connected so as to be bidirectionally, forward-and backwardly, rotatable in unison, leaving the pressure roller 22 under strong spring force. At the same time the switch 59 shown in FIG. 15 is closed for switching the control device 60 for changing over the rotation amount of the motor 11, and the paper length preset device 54 shown in FIG. 14 is adjusted for being set according to the size of the cut sheet paper $P_2$.

Due to the rotation of the operating lever 44 to the fourth position, on the other hand, the follower pin 50 of the connecting lever 49 is made contact the second cam portion **46*b* of the cam surface 46 and the paper guide 33 is positioned at the upper position, with the abutments 33*a* thereof being positioned right beneath the printing position. When the cut sheet paper $P_2$ is inserted between the both rollers 5, 22 in this situation the lower end thereof is received by the abutments 33*a* for being firmly positioned at a predetermined position. When afterwards the operating lever 44 is rotated from the fourth position to the second position in FIG. 2, the cut sheet paper $P_2$ is first held by the both rollers 5, 22 at the third position in FIG. 3 and at the second position in FIG. 2 the support plate 15 is moved to the forwardmost by the engagement of the follower pin 47 of the support plate 15 with the second notch 45*b* of the cam surface 45. Due to the aforementioned setting of the plate 24 to the forward position, the pressure roller 22 is urged to the drive roller 5 strongest, with the cut sheet paper $P_2$ being held between the two rollers 5, 22. The cut sheet paper $P_2$ is therefore held with a strong pinching force therebetween. At the time of moving of the operating lever 44 from the third position in FIG. 3 to the second position in FIG. 2 the follower pin 50 of the connecting lever 49 is returned to the state contacting the first cam portion 46***a*, followed by the returning of the paper guide 33 to the lower position. On the other hand, the stud 53 of the clutch rod 10 is not contacted with the end of the arcuate slot 52 in the plate 51, so the clutch rod 10 is maintained at the position shown in FIG. 6 and consequently the drive shaft 4 and the pulley 7 is kept at the earlier mentioned state of connection. When the paper load switch 56 shown in FIG. 14 is then operated the motor control device 55 will be applied a signal, and the motor 11 is rotated by an amount corresponding to the set amount of the paper length preset device 54 for rotating the drive roller 5 by a predetermined amount clockwise in FIG. 2. Therefore the cut sheet paper $P_2$ is fed by the drive roller 5 and the pressure roller 22 as far as the print starting position.

After the cut sheet paper $P_2$ is thus set the print head 3 is operated by suitable signals for performing printing on the set paper. After each finishing of one line printing the line space drive switch 57 is operated so as to do the line spacing through rotation of the both rollers 5, 22 due to the motor 11.

At this time the amount of rotation of the motor 11 is reduced by 10% by the function of the control device 60 for rendering the paper drawing out amount given by the both rollers 5, 22 identical to that for the perforated paper $P_1$, so that the line spacing in the cut sheet paper $P_2$ may be carried out at the same stroke as in the perforated paper $P_1$. It enables the printing on the cut sheet paper $P_2$ to be carried out exactly at a predetermined position.

What is claimed is:

1. A printing paper feeding mechanism for a printer comprising:

a perforated paper feed device provided with a pin tractor, for feeding a web with holes perforated at periodic locations along both edges toward a printing position, fittable into said perforations;

a paper draw-out device comprising a rotatable drive roller and a pressure roller, abuttable thereto for being able to rotate associated therewith, for drawing out a paper printed at the printing position therefrom while holding said paper under pressure between both rollers;

a transmitting device for connecting said perforated paper feeding device and said paper draw-out device to impart larger amount paper drawing out action to said paper draw-out device than paper feeding amount by said perforated paper feed device;

a motor for driving said perforated paper feed device and said upper draw-out device;

a rotation amount controlling means for changing amount of rotation of said motor for a unit line spacing amount in response to the type of paper fed, such that fed amount of paper in either case wherein the perforated paper is fed by said perforated paper feed device and said paper draw-out device and wherein a cut shet paper is fed by said paper draw-out device alone may be made equal; and a pressure controlling means for changing contact pressure of said pressure roller to said drive roller to a weaker level, while paper feeding by said perforated paper feed device is conducted, than that in otherwise operation.

2. A printing paper feeding mechanism claimed in claim 1, wherein said pressure roller is supported at both ends thereof movably in radial direction by a pair of support members and biased toward said drive roller by springs disposed between said pressure roller and said support members, and said pressure controlling means is means for moving said pair of support members at least between one position where said support members make said springs deflect by a predetermined amount and another position where said support members make said springs deflect by a larger amount than at said one position.

3. A printing paper feeding mechanism claimed in claim 1, wherein said pressure roller is supported at both ends thereof movably in radial direction by a pair of support members and biased toward said drive roller by springs disposed between said pressure roller and an anchor member supported by said support members, and said pressure controlling means is means for moving said anchor member at least between one position where said anchor member make said springs deflect by a predetermined amount and another position where said anchor member make said springs deflect by a larger amount than at said one position.

4. A printing paper feeding mechanism for a printer comprising:

a perforated paper feed device provided with a pin tractor, for feeding a web with holes perforated at periodic locations along both edges toward a printing position, fittable into said perforations;

a paper draw-out device comprising a rotatable drive roller and a pressure roller, abuttable thereto for being able to rotate associated therewith, for drawing out a paper printed at the printing position therefrom while holding said paper under pressure between both rollers;

a transmitting device for connecting said perforated paper feeding device and said paper draw-out device to impart larger amount paper drawing out action to said paper draw-out device than paper feeding amount by said perforated paper feed device;

a motor for driving said perforated paper feed device and said paper draw-out device; and a rotation amount controlling means for changing the amount of rotation of said motor for a unit line spacing amount in response to the type of paper fed, such that fed amount of paper in either case wherein the perforated paper is fed by said perforated paper feed device and said paper draw-out device and wherein a cut sheet paper is fed by said paper draw-out device alone may be made equal.

5. A printing paper feeding mechanism claimed in claim 1 or 4 wherein said transmitting device comprises a first gear secured on a motor shaft of said motor, a second gear secured on a drive shaft of said pin tractor for being engaged with said first gear, a first pulley secured on said motor shaft, a second pulley mounted on a drive roller shaft of said drive roller for delivering at least forward rotation to said drive roller shaft, and a belt stretched between said first pulley and said second pulley, gear ratio between said first gear and said second gear being so determined as to make paper-drawing-out speed of said paper draw-out device faster by a predetermined rate than paper feeding speed of said perforated paper feed device.

6. A printing paper feeding mechanism claimed in claim 1 or 4, wherein said rotation amount controlling device comprises an electric switch and a control circuit connected to said electric switch and said motor for changing over the rotation amount of said motor according to operation state of said electric switch.

7. A printing paper feeding mechanism claimed in claim 1 or 4, wherein said paper draw-out device further comprises a pulley rotatably mounted on a drive roller shaft of said drive roller for being driven by said motor, a one-way clutch disposed between said pulley and said drive roller shaft for delivering only forward rotation of said pulley to said drive shaft, a clutch member mounted on said drive roller shaft shiftably in axial direction but not rotatably, an engaging portion disposed on said pulley for engaging with said clutch member to make said pulley and said drive roller shaft bidirectionally rotate in unison, a spring biasing said pulley and said clutch member in separating direction from each other, and a clutch operating member movably disposed to make said clutch member engage with the engaging portion of said pulley when the cut sheet paper is fed.

8. A printing paper feeding mechanism for a printer comprising:

a paper feed device, disposed above a printing position, comprising a rotatable drive roller and a pressure roller abuttable to said drive roller and rotatable in association therewith for feeding a cut sheet paper while holding said paper between the both rollers under pressure;

an operable member which is operated for separating said pressure roller from said drive roller to load said paper from above said printing position passing through between the both rollers;

a positioning member, normally located at an original position so as not to obstruct the paper feeding operation, and shiftable to an operative position beneath the printing position for being abutted by, and for supporting, the lower end of said paper when it is loaded;

linkage means for linking said positioning member and said operable member to move said positioning member to said operative position prior to the separating operation of said pressure roller owing to operation of said operable member and to return said positioning member from said operative position to said original position after said pressure roller has been abutted onto said drive roller; and an initial drive means for rotating said drive roller for the purpose of transporting said paper loaded by the operation of said operable member to a print starting position.

9. A printing paper feeding mechanism for a printer comprising:

a first paper feed device provided with a pin tractor, for feeding a web with holes perforated at periodic locations along both edges toward a printing position, engageable with said perforations;

a second paper feed device, disposed above the printing position, comprising a rotatable drive roller and a pressure roller abuttable to said drive roller and rotatable in association therewith for drawing out the web fed by said first paper feed device and for feeding a cut sheet paper while holding them between the both rollers under pressure;

a bidirectionally rotatable motor for driving said first paper feed device and said second paper feed device;

an operable member which is operated for separating said pressure roller from said drive roller to load the cut sheet paper from above said printing position passing through between the both rollers;

a positioning member, normally located at an original position so as not to obstruct the paper feeding operation, and shiftable to an operative position beneath the printing position for being abutted by, and for supporting, the lower end of the cut sheet paper when it is loaded;

linkage means for linking said positioning member and said operable member to move said positioning member to said operative position prior to the separating operation of said pressure roller owing to operation of said operable member and to return said positioning member, from said operative position to said original position after said pressure roller has been abutted onto said drive roller;

a backward drive means for backwardly rotating said motor to actuate said drive roller for the purpose of transporting the cut sheet paper loaded to a print starting position;

a transmitting device for connecting said first paper feed device and said second paper feed device to impart larger amount paper drawing out action to said second paper feed device than paper feeding amount by said first paper feed device; and a rotation amount controlling means for changing the amount of forward rotation of said motor for a unit line spacing amount in response to the type of paper fed, such that fed amount of paper in either case wherein the web is fed by said first paper feed device and said second paper feed device and wherein the cut sheet paper is fed by said second paper feed device alone may be made equal.

10. A printing paper feeding mechanism claimed in claim 8 or 9, wherein said positioning member is disposed on a paper guide movable between an upper position where said positioning member is positioned at said operative position and a lower position where said positioning member is positioned at said original position, and a downward slant guide portion is fixedly disposed for being adjacent to said positioning member positioned at said original position to guide a lower end of the loaded cut sheet paper not to engage with said positioning member.

11. A printing paper feeding mechanism claimed in claim 8 or 9, wherein said linkage means comprises a movable paper guide on which said positioning member is fixedly disposed, a connecting lever pivoted to a stationary frame at a middle portion thereof for being engaged with said paper guide at one end thereof, a movable support member supporting both ends of a shaft of said pressure roller and a cam portion on said operable member for being engaged with said movable support member and the other end of said connecting lever.

* * * * *